US005169144A

United States Patent [19]

Aaron

[11] Patent Number: 5,169,144

[45] Date of Patent: Dec. 8, 1992

[54] SHEET SORTING APPARATUS

[75] Inventor: Jack Aaron, Tustin, Calif.

[73] Assignee: Optimotion, Inc., Costa Mesa, Calif.

[21] Appl. No.: 696,772

[22] Filed: May 7, 1991

[51] Int. Cl.[5] ..... B65H 31/24

[52] U.S. Cl. ..... 271/293; 271/294

[58] Field of Search ..... 271/293, 294

[56] References Cited

U.S. PATENT DOCUMENTS 4,420,325 9/1980 Tates ..... 271/293

4,671,505 6/1987 Hidaka ..... 271/293

*Primary Examiner*—Richard A. Schacher

*Attorney, Agent, or Firm*—Herbert M. Shapiro

[57] ABSTRACT

A sheet sorting apparatus of the shifting tray type employs a pair of helical coils, each coil being predominantly wound with a number of turns of a first pitch, and containing at least one turn of a second, coarser pitch. The ends of each coil are held by through holes of a center rod that extends along the longitudinal axis of each coil, a coil and center rod thus forming a coil assembly. Each center rod is rotationally supported and has a rotational drive coupling attached at one end; a rotational driver being attached thereto is able to rotate both coil assemblies in the same direction at the same speed. A number of trays are arranged in a vertical stack, each tray capable of supporting a number of sheets and having a tray lift insert attached at each side. The tray lift inserts each have a helical passageway therethrough for accepting at least one revolution of one coil therein. The trays are oriented such that the inserts are engaged with the coils, the coils thereby holding the trays in position in the vertical stack. When the rotational driver rotates the coil assemblies, the tray lift inserts traverse the coils, causing the trays to change vertical position. All trays move in fixed space relationship except for each tray in turn when traversing the at least one turn of coarser pitch, whereby each tray in turn moves momentarily to a position of greater spacing with respect to the following tray and thus accommodating the entry of a sheet into each following tray in turn.

3 Claims, 5 Drawing Sheets

SHEET SORTING APPARATUS

FIELD OF THE INVENTION

This invention relates to paper sheet processing machines. More particularly, this invention relates to compact paper sheet sorting machines of the shifting tray type.

BACKGROUND OF THE INVENTION

A variety of compact sorting machines exist for receiving and sorting sheets from an output slot of a paper sheet processing machine, such as a machine. Generally, these sorting machines provide a number of trays supported in a compact vertical stack, each of which, in turn, is capable of traversing past the sheet output slot. To accommodate paper entry into each receiving tray in turn, a relatively large gap is required between the receiving tray and the tray immediately above the receiving tray. Tray spacing elsewhere may be minimized in order to increase the compactness of the vertical stack. Several tray shifting methods have been devised to accomplish this variable tray spacing requirement.

One sheet sorting machine, taught in U.S. Pat. No. 4,343,463, issued to Lawrence on Aug. 10, 1982, uses two rotating spiral cams to shift each tray, in turn, past the output slot of a copy machine. One drawback to this device is that spring means are needed to force two protruding trunnions of the next tray to be shifted into the cam tracks of the rotating spiral cams. This spring tension must be overcome when the trays are returning from the opposite direction. Moreover, relatively complex tray support frames are needed to ensure that each tray is properly positioned as the tray is to be moved by the rotating cams. Another drawback to this tray shifting technique is that the tray support frame must be allowed to move with the bottom tray, adding to the complexity of the machine. Other sorting machines also utilize this tray shifting means.

Another tray shifting method utilizes two rotating wheels, each with two or more notches formed in their perimeters. Upon rotation of each wheel, one notch engages a trunnion on either side of the next tray to be shifted and transports it along a track otherwise blocked by the wheel. Similar drawbacks exist for this type of tray shifting method, as spring biasing means must be employed to ensure that the trunnions of the next tray to be shifted will properly engage each notch in each wheel. Moreover, as the wheels engage the trunnions of a tray, a sudden strain is introduced to the rotational driving means of the wheels by the weight of the tray, which is often considerable when the tray is supporting a large number of sheets. As a result, driving force and support structure requirements are significant.

The prior art teaches, in moving bin sorting machines, that all trays, as an assembly, and in some cases a retaining frame as well, must be lifted by a single pair of trunnions, one on each side of the assembly. This results in excessive wear and a low mean time between failure.

Clearly, then, there is a need for a simple, reliable method of shifting trays sequentially past an output slot of a copy machine while providing a larger distance between the receiving tray and the tray immediately above the receiving tray, and a smaller distance between each of the other adjacent trays. The present invention fulfills these needs and provides further related advantages.

SUMMARY OF THE INVENTION

The present invention is a sorting apparatus for paper sheets that utilizes a pair of helical coils or screws to shift trays past the output slot of a copy machine or the like. Each coil is predominantly wound with a plurality of turns of a first pitch, and also includes at least one turn of a second, coarser pitch. Each coil is rotatably supported in a generally vertical attitude. A reversible rotational driving means, such as an electric motor and a drive train, rotate the coils around their longitudinal axes at the same speed and in the same direction.

A number of trays suitable for supporting a plurality of sheets are arranged in a vertical stack. An attachment means, such as a nut, is mounted to each of two sides of each tray, each attachment means having a helical passageway therethrough for accepting at most one revolution of a coil therein.

In operation, the rotational driving means, upon receiving a signal from a conventional control circuit of the copy machine, rotates the coils, thereby shifting all trays either up or down in accordance with the rotational direction of the coils. Consequently, each tray having the attachment means engaged in the coils on the first pitch moves at a first speed upward or downward as the pair of coils turn, and at a second, faster speed when the attachment means moves to the second pitch, so that the space between trays increases as each tray moves to the second pitch, thereby allowing a sheet of paper to more easily feed into a tray positioned with the increased spacing.

The tray shifting method of the invention disclosed herein has the advantage of utilizing a minimum number of moving parts, decreasing the complexity and cost of its manufacture. Moreover, the present invention is not dependent upon complex tray support frames, or spring tensioning means, and as a result is less likely to jam or otherwise malfunction. Another important advantage of the current invention is that all trays are supported and lifted individually. This requires only about 25% of the driving torque as compared to prior art devices, resulting in lower wear, longer life, and lower power use. Prior art devices requiring large torque application are limited to slower speeds and create high levels of audible noise, while the current invention has been able to achieve relatively high speeds at reduced audible noise levels. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
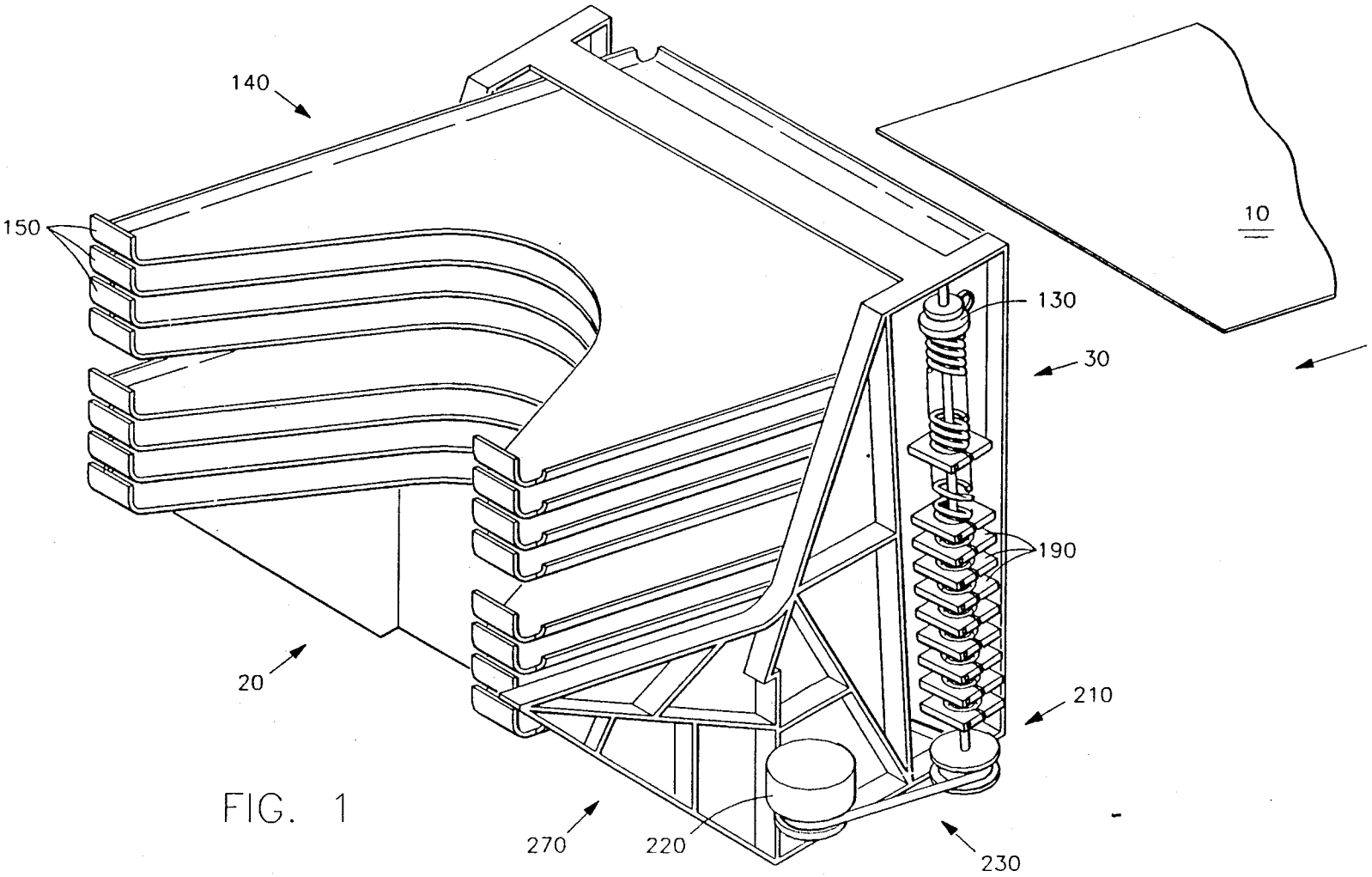
FIG. 1 is a perspective view of the invention, illustrating a coil and a number of lift blocks of the invention.
Figure 4:
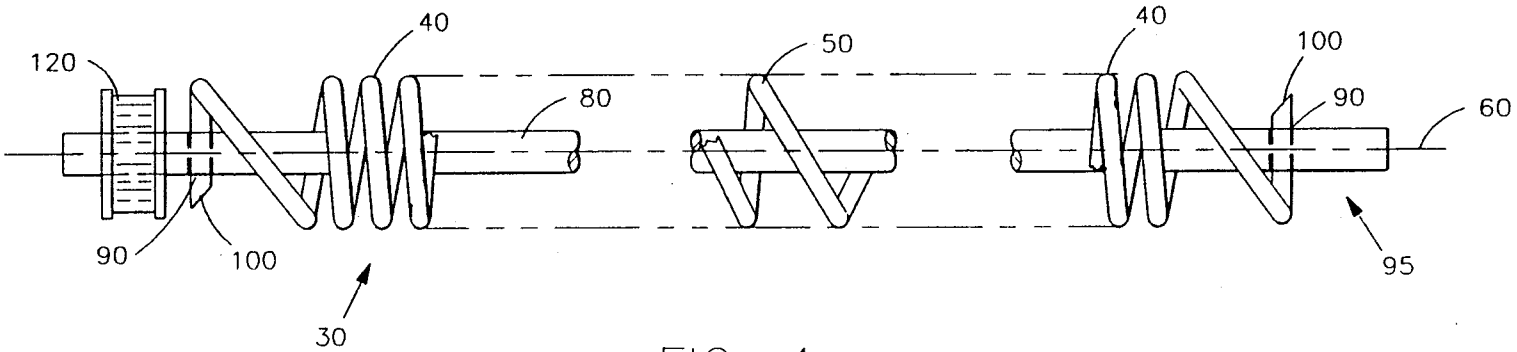
FIG. 4 is a front view of a coil and center rod of the embodiment of FIG. 1.

FIG. 1 shows a sorting apparatus 20 of the shifting tray type for sheets 10. As shown in FIG. 4, helical coils 30 are wound with a plurality of turns of a first pitch 40, and at least one turn of a second, coarser pitch 50. Each coil 30 has a central longitudinal axis 60 therein. A center rod 80 is positioned on axis 60 of each coil 30. Each center rod 80 has a pair of transverse through holes 90 positioned to receive the ends 100 of one coil 30. Preferably, each coil 30 and center rod 80 are made from a strong, rigid material, such as steel.

In an alternate embodiment of the invention, each coil 30 is replaced by a screw 111 (FIGS. 7A and 7B), eliminating the need for the center rod 80. The cost of manufacturing a screw with a first pitch 41 and a second, coarser pitch 51 is higher than that of manufacturing coil 30 plus center rod 80, and as a result is not the preferred mode of the invention. Clearly, however, both the coil 30 and the screw 111 operate in a similar fashion and produce the same result.

Figure 2:
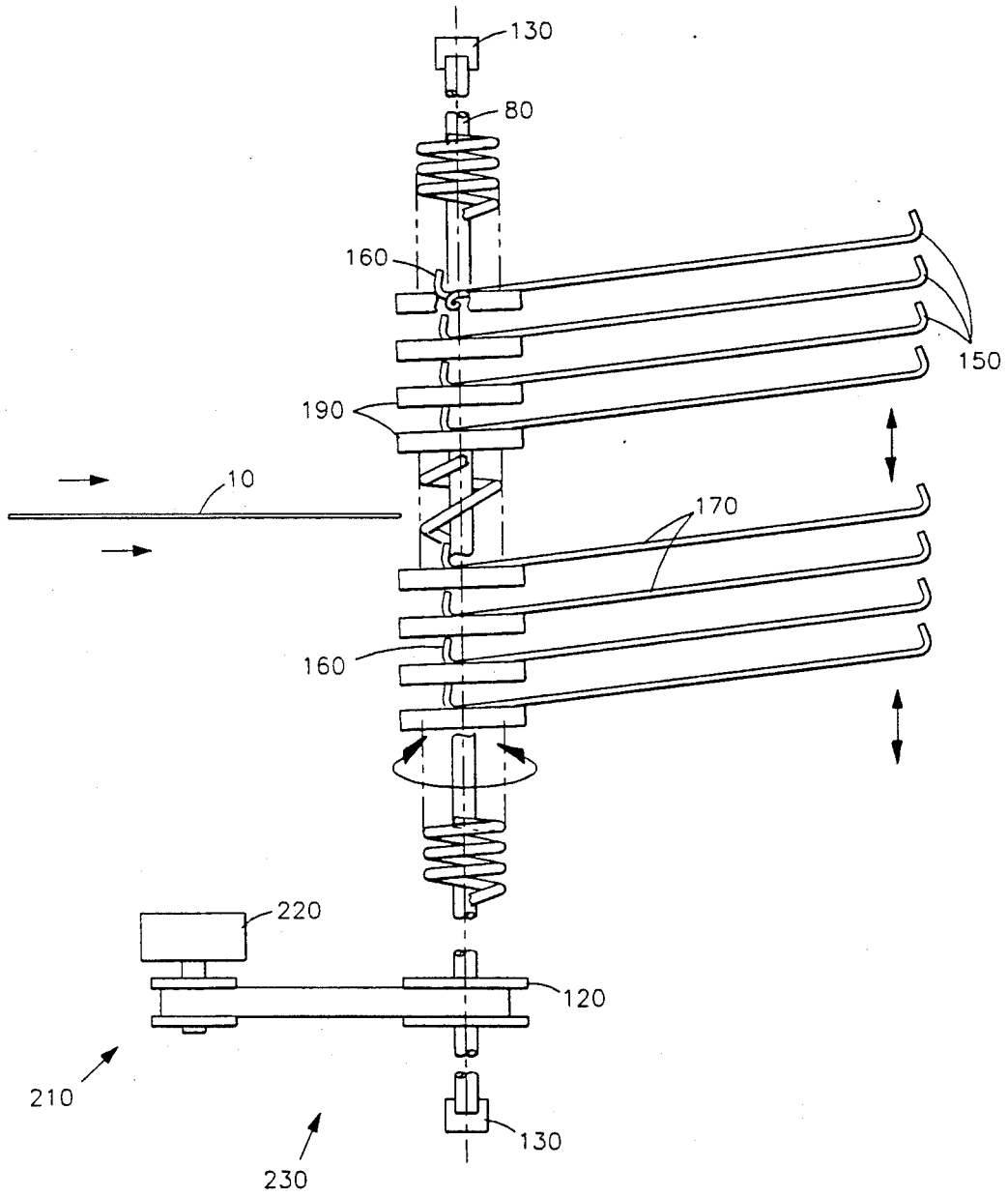
FIG. 2 is a schematic right side elevation view of the embodiment of FIG. 1, showing a tray stack and means for accommodating a paper sheet into a tray.
Figure 3:
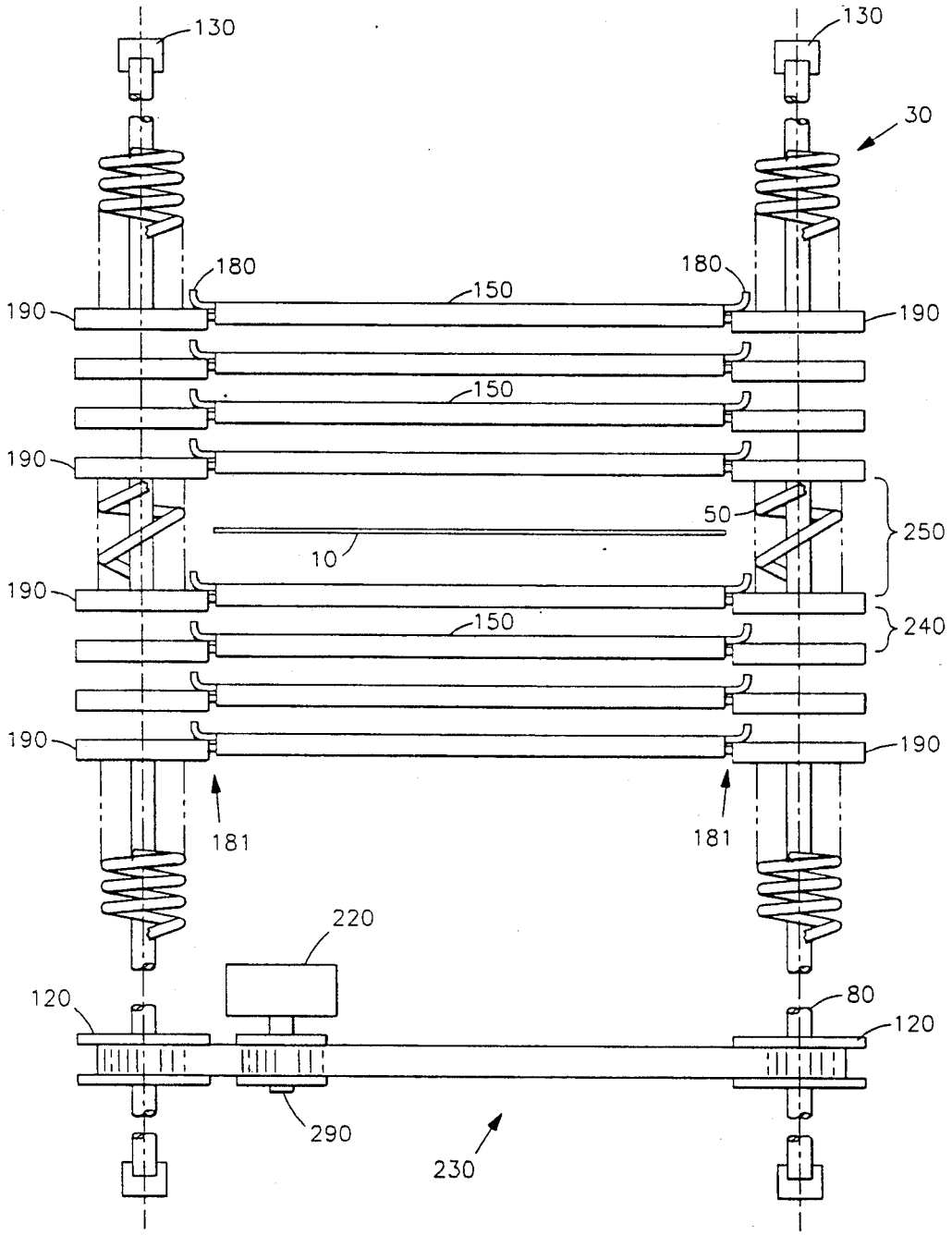
FIG. 3 is a schematic front elevation view of the embodiment of FIG. 1.
Figure 5:
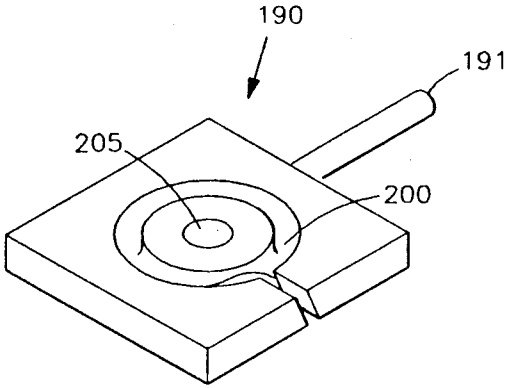
FIG. 5 is a perspective illustration of a tray lift block of the embodiment of FIG. 1.

As shown in FIGS. 2 and 3, a rotational drive coupling means 120 is fixed to each center rod 80. Each center rod 80 is held in a near vertical attitude by a pair of rotational support means 130. A rotational driving means 210 comprises, in the preferred mode of the invention, a prime mover 220 and a drive train 230. Preferably, the prime mover 220 is a reversible electric motor, and the drive train 230 is a flexible drive belt interconnecting the shaft 290 of the electric motor with the rotational drive coupling means 120 of each center rod 80. When activated, the rotational driving means 210 drives each coil 30 in the same direction at the same speed.

Figure 7A:
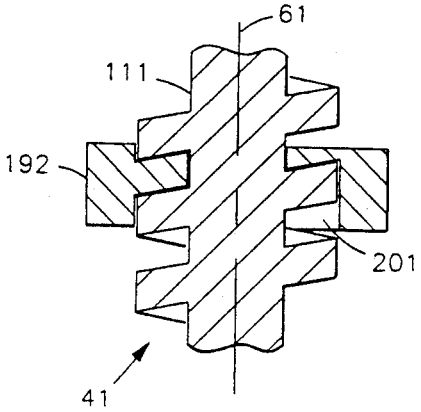
FIG. 7A is a fragmentary cross sectional view of a tray lift block and one turn of a threaded screw at threads of a first pitch.
Figure 7B:
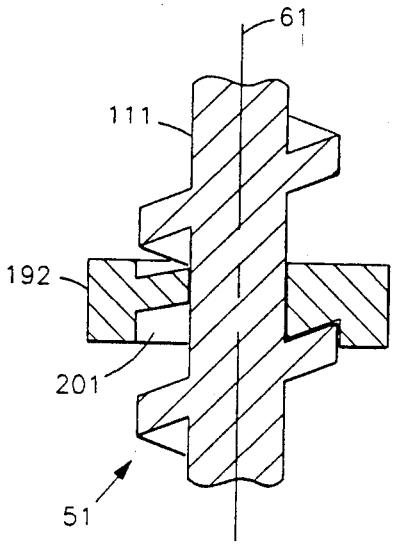
FIG. 7B is a fragmentary cross sectional view of a tray lift block and one turn of a threaded screw at threads of a second, coarser pitch.
Figure 6A:
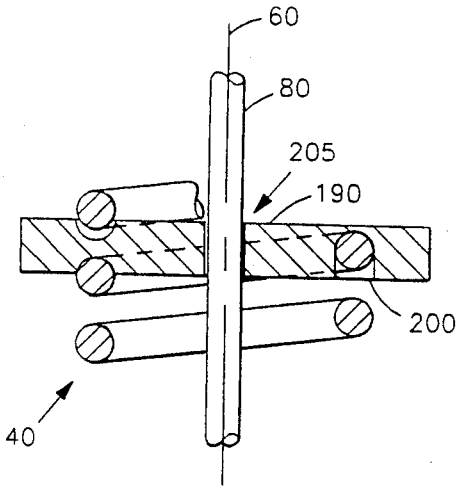
FIG. 6A is a fragmentary cross sectional view of a tray lift block and one turn of a coil of a first pitch.
Figure 6B:
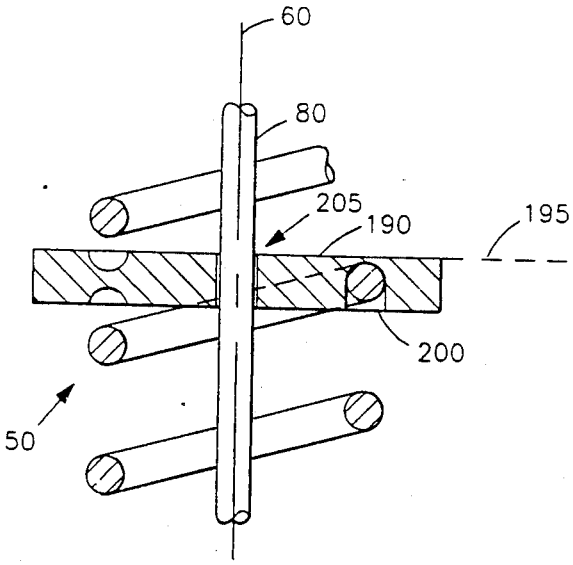
FIG. 6B is a fragmentary cross sectional view of a tray lift block and one turn of a coil of a second, coarser pitch.

A plurality of trays 150, preferably of a strong yet light plastic material, are arranged in a vertical stack 140, each tray 150 having a leading edge 160 for receiving the sheets 10, and a surface 170 for supporting the sheets 10. Each tray 150 has two tray lift blocks 190, mounted on opposite sides of the tray 150. The blocks 190 have a helical passageway 200 for accepting at most one turn of one coil 30, allowing the coil 30 to pass through only when the coil 30 is rotated relative to the block 190. Each tray lift block 190 has a center rod hole 205, which is a clearance hole for the passage of the center rod 180. The trays 150 are oriented so that the tray lift blocks 190 are engaged with the coils 30, the coils 30 being positioned on opposite sides of the trays 150 and thereby holding the trays 150 in position in the vertical stack 140. In the preferred mode of the invention, each tray lift block 190 is made of a strong plastic with a low coefficient of friction to facilitate the passage of one coil 30 through the helical passageway 200. In an alternate embodiment the coils 30 are replaced by screws 111 and tray lift blocks 190 are replaced by tray lift nuts 192 (FIGS. 7A and 7B).

The prime mover 220 is able to rotate the coils 30 in either direction, causing the blocks 190 to traverse the coils 30 and further to cause the leading edges 160 of the trays 150 to change vertical position. As a result, all trays 150 may be brought into a position to receive sheet 10 which is normally ejected from a copy machine or similar apparatus. As trays 150 move upward or downward they maintain a normal close spacing 240, as shown in FIG. 3, as long as the blocks are engaged on first pitch 40 of coils 30. As the blocks 190 of a given tray 150 move onto and engages second pitch 50 of coils 30, the given tray 150 moves rapidly away from the following tray 150, thereby opening up a wider space 250. The wider space 250 provides improved clearance for incoming sheet 10 to enter the following tray 150. This same result occurs for each following tray 150 in turn.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A sheet sorting apparatus of the shifting tray type for receiving paper sheets, comprising;

a pair of helical coils, each coil of said pair of helical coils being predominantly wound with a plurality of turns of a first pitch, and containing at least one turn of a second pitch, the second pitch being coarser than the first pitch, each coil having a longitudinal axis;

means for rotational support, the support means holding the coils in positions wherein said longitudinal axes of the coils are approximately parallel to each other;

means for rotational drive, the drive means rotating each coil about said longitudinal axis, both coils rotating in the same sense and at the same speed of rotation;

a plurality of trays arranged in a stack, each said tray being separated from an adjacent said tray by a space, each tray having a leading edge for receiving the sheets, two side edges on either side of the leading edge, the side edges defining the sides of the stack, and a surface for supporting the sheets, one said coil being positioned adjacent to each of said sides of the stack; and a plurality of tray lift blocks, each tray having a pair of the tray lift blocks for attachment of the tray to coils, each tray lift block having a means for tray engagement and a helical shaped guideway therethrough, the guideway providing clearance for sliding engagement of the tray lift block with the coil so that as the coil rotates the attachment means moves along the coil in accordance with the direction of rotation of the coil;

whereby the stack of trays move; along the pair of coils as the coils rotate, the space between each pair of adjacent trays being approximately equal for adjacent trays moving on the coil turns of the first pitch, the space between each pair of adjacent trays growing to a larger spacing as each tray moves into the coil turns of the second pitch, the larger spacing facilitating the ingress of the sheet of paper, so that each tray in turn may receive a paper sheet.

2. The apparatus of claim 1 wherein the helical shaped guideway encompasses approximately one complete coil turn of the first pitch and a fraction of a coil turn of the second pitch.

3. The apparatus of claim 1 further including a center rod for mounting the coil, each end of the center rod having a transverse through hole for accepting one end of the coil, the rod being positioned coaxially through the coil, and wherein the attachment means has a clearance hole for passage of the center rod, the center rod acting to restrain the tray lift block from tilting out of planes orthogonal to the axis of the coil.

* * * * *